US006481585B1

(12) United States Patent
Cloughton

(10) Patent No.: US 6,481,585 B1
(45) Date of Patent: Nov. 19, 2002

(54) DEVICE FOR USE IN FITTING A DUVET COVER

(76) Inventor: Peter Cloughton, 14 Campion Gate, Grange Park, Swindon, Wiltshire SN5 6JN (GB)

( * ) Notice: Subject to any disclaimer, the term of this patent is extended or adjusted under 35 U.S.C. 154(b) by 0 days.

(21) Appl. No.: 09/672,740

(22) Filed: Sep. 28, 2000

(30) Foreign Application Priority Data

Oct. 6, 1999 (GB) ..... 9923505

(51) Int. Cl.[7] ..... A47F 5/00

(52) U.S. Cl. ..... 211/89.01; 211/118; 211/124; 211/87.01

(58) Field of Search ..... 211/118, 113, 211/124, 105.1, 105.3, 119.004, 89.01; 223/89, 90, 91

(56) References Cited

U.S. PATENT DOCUMENTS

| | | | | |
|---|---|---|---|---|
| 1,350,219 A | * | 8/1920 | Gibbs | |
| 2,473,408 A | * | 6/1949 | Alkin | |
| 2,554,825 A | * | 5/1951 | Grimberg | |
| 2,633,276 A | * | 3/1953 | Gillespie et al. | |
| 2,710,695 A | * | 6/1955 | Mazany | |
| 2,825,469 A | * | 3/1958 | Watkins et al. | 211/105.3 |
| 3,874,572 A | * | 4/1975 | McClenning | |
| 5,014,948 A | * | 5/1991 | Asaro et al. | |
| 5,992,713 A | * | 11/1999 | Manabat | 223/91 |
| 6,206,254 B1 | * | 3/2001 | Lin | 223/90 X |

FOREIGN PATENT DOCUMENTS

| | | |
|---|---|---|
| DE | 27 17 905 | 11/1978 |
| GB | 305 315 | 8/1928 |
| GB | 925386 | 5/1963 |
| GB | 2 247 169 | 2/1992 |
| GB | 2 291 343 | 1/1996 |
| GB | 2 304 141 | 3/1997 |
| NL | 9 302 182 | 7/1995 |
| WO | 87/07127 | 12/1987 |

* cited by examiner

*Primary Examiner*—Robert W. Gibson, Jr.
(74) *Attorney, Agent, or Firm*—Andrus, Sceales, Starke & Sawall

(57) ABSTRACT

A device for use in fitting a duvet cover comprises an elongate carrier (10), means (18) for removably mounting the carrier (10) on a support, and two releasable clamping devices(11). At least one of the releasable clamping devices (11) is mounted such that its position may be adjusted longitudinally.

15 Claims, 3 Drawing Sheets

FIG 5
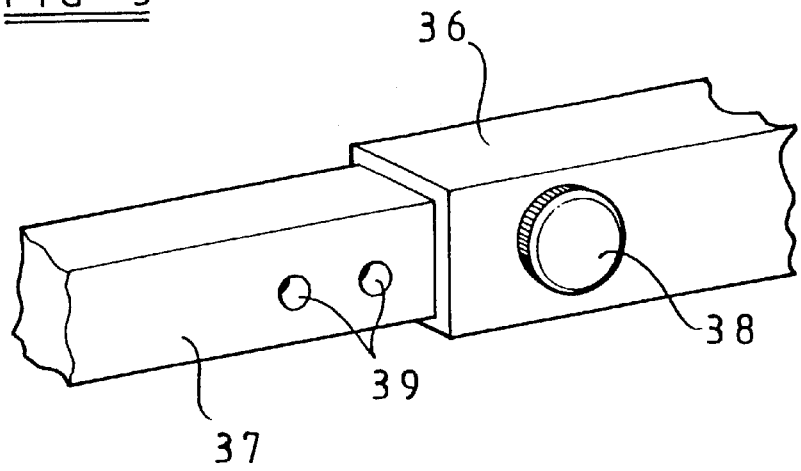
FIG 6
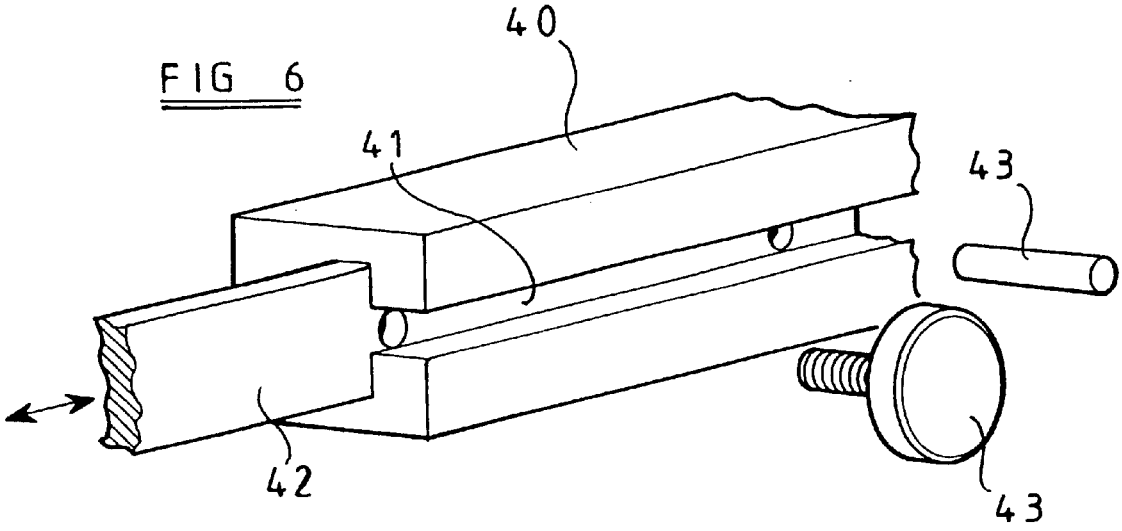
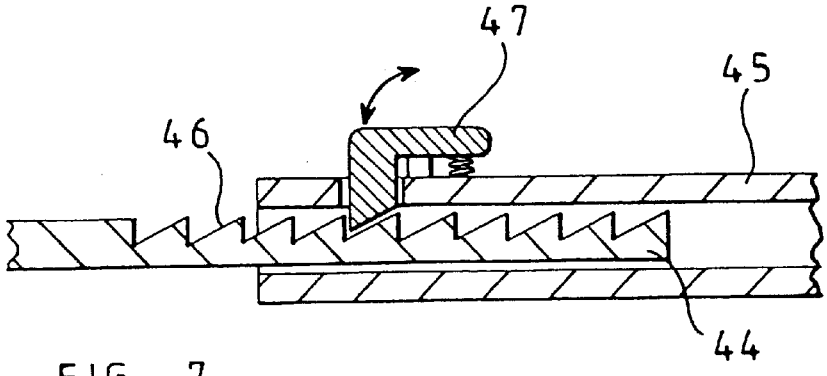
FIG 7

DEVICE FOR USE IN FITTING A DUVET COVER

The invention provides a device for use in fitting a duvet cover.

As is well known, a duvet is a form of bed covering comprising a quilted fabric casing which is filled with warmth-retaining material such as synthetic flock or natural feathers. It is common practice for the duvet, when in use on a bed, to be contained within a removable washable fabric cover of generally the same size as the duvet.

The duvet cover is closed on three sides, the fourth side being left open, or partly open, so that the duvet can be inserted into the cover. Press studs, ties or other fastening devices can be provided along the open side so that it may be closed once fitted over the duvet.

Since the duvet and cover may be as large as a king-size double bed, considerable difficulty is often experienced in fitting the cover over the duvet. One common method is to push the duvet into the cover through the open side and then, once the duvet is inside the cover, to manipulate it, through the cover, so that the duvet flattens out and its corners extend into the four comers of the cover. This can be a time-consuming and frustrating operation, often requiring two persons. Another method is to turn the duvet cover inside-out, align its closed end with the corresponding end of the duvet, and then to draw the cover over the duvet as the cover is turned outside-in again. Since it is generally necessary to hold the closed end of the cover in contact with the end of the duvet as the cover is turned outside-in, this operation also is difficult for one person alone to carry out.

The present invention sets out to provide a device which may be used when fitting a duvet cover over a duvet, so as to enable this operation to be carried out easily by one person.

According to the invention there is provided a device for use in fitting a duvet cover, comprising an elongate carrier having means for removably mounting the carrier on a support in a substantially horizontal position, and two releasable clamping devices mounted on the carrier in longitudinally spaced locations, at least one of the clamping devices being so mounted on the carrier that its position may be adjusted longitudinally thereof, whereby the distance between the clamping devices may be varied.

In use the device is mounted on a convenient support, such as the top of an open door, and the distance between the clamping devices is adjusted so as to be substantially equal to, or slightly less than, the width of the duvet. The duvet cover is then ruched up so that its open end is brought close to its opposite closed end and is applied to the end of the duvet so that the two corners of the duvet at that end engage within the corresponding comers of the duvet cover. The end edges of the duvet and duvet cover are then extended between the clamping devices and each clamping device is clamped on to the aligned comers of the duvet and cover. This operation may be effected before or after the device is mounted on the door or other support.

The duvet, with the cover ruched along its top edge, hangs from the device under its own weight and it is then a simple matter to draw the ruched cover downwards along the length of the duvet until the open end of the cover clears the lower end of the duvet and may be buttoned or otherwise closed. The covered duvet is then removed from the clamps on the device and may be placed on the bed without further manipulation of the duvet within the cover being required.

In order to facilitate drawing of the cover downwards over the duvet, it is desirable that the upper end of the duvet should be as taut as possible when fitted to the device. Since at least one of the clamping devices is adjustable, they may be moved further apart, after the duvet has been fitted to them, so as to render the upper end of the duvet as taut as possible, before pulling the cover downwards over the duvet.

Preferably both clamping devices are so mounted on the carrier that their positions may be independently adjusted longitudinally of the carrier.

In any of the above arrangements there may be mounted on the carrier one or more further clamping devices located between the first two said clamping devices. For example, there may be provided a central clamping device mounted on the carrier substantially mid-way between the first two said clamping devices. The further clamping device or devices may be fixedly or adjustably mounted on the carrier.

The carrier may be in the form of an elongate bar. The carrier is preferably collapsible to reduce the size thereof for storage. For example, the carrier may comprise two or more sections hingedly connected together so that the carrier may be folded from an extended condition to a collapsed condition where the hinged sections at least partly overlie one another.

Preferably the sections are connected together by one or more hinges located at the top of the carrier for pivoting about horizontal axes transverse to the length of the carrier, whereby the sections tend to be held in the extended conditions by the weight of the duvet suspended from the clamping devices.

Alternatively, the carrier may comprise two or more sections which are relatively slidable longitudinally between an extended condition and a collapsed condition. For example, the relative slidable sections may be telescopically arranged, one being slidable within another.

In any of these arrangements releasable retaining means are preferably provided to retain the sections in the extended condition.

The or each adjustable clamping device may be continuously adjustable longitudinally of the carrier, or may be adjustable in steps between a number of discrete positions relative to the carrier. In either case releasable detent means are preferably provided to maintain the clamping device in a selected longitudinal position with respect to the carrier. The detent means may be an automatic spring snap device, and in this case the snap device may be manually releasable. Alternatively, the detent means may be a manually engageable and releasable device, such as a screw clamp.

The or each movable clamping device may be directly mounted on the carrier, or may be fixedly mounted on an intermediate member which is, in turn, movably mounted on the carrier. For example, the clamping device may be fixedly mounted on a member which is slidable longitudinally with respect to the carrier. The intermediate member may be telescopically arranged with respect to the carrier.

Each clamping device may comprise two relatively movable parts which are urged towards one another by spring means. Alternatively or additionally, manually operable means, such as a screw device, may be provided to urge the parts of the clamping device towards one another.

One of the parts of the clamping device may be fixed relative to the carrier, the other part being movable towards and away from the fixed part. The relatively movable parts of the clamping device may be pivotally mounted with respect to one another.

In any of the above arrangements the means for removably mounting the carrier on a support may comprise a hook device. For example, the hook device may comprise at least one hook which projects rearwardly from the carrier in such manner that it may be hooked over the other edge of an open door, picture rail or the like. There may be provided two or more such hooks spaced apart longitudinally of the carrier.

The following is a more detailed description of specific embodiments of the invention, by way of example, reference being made to the accompanying drawings in which.

Figure 3:
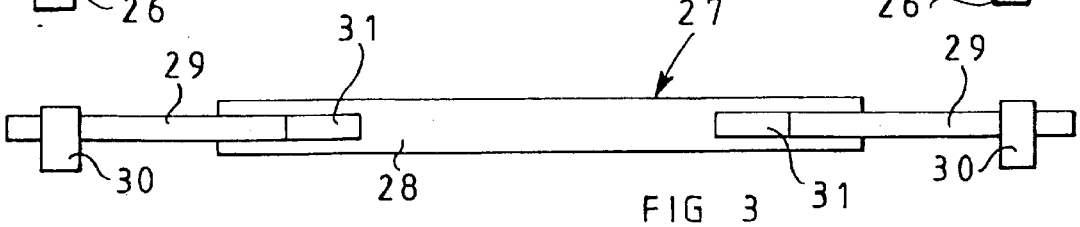
Figure 8:
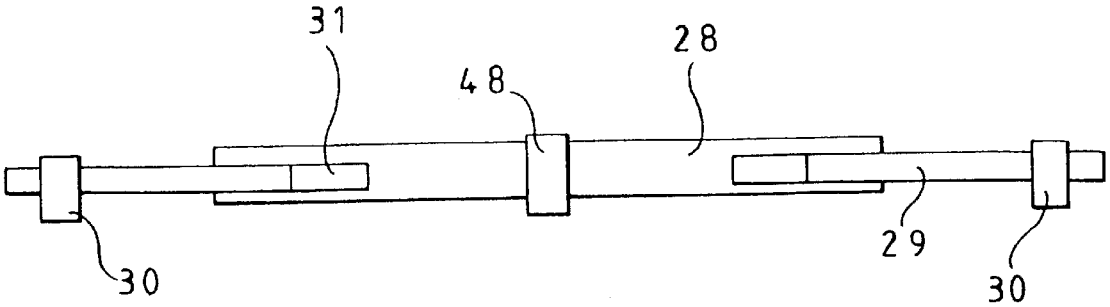
Figure 9:
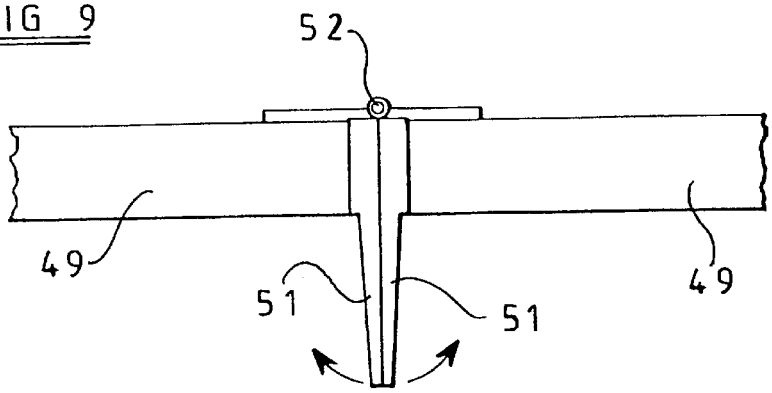
Figure 10:
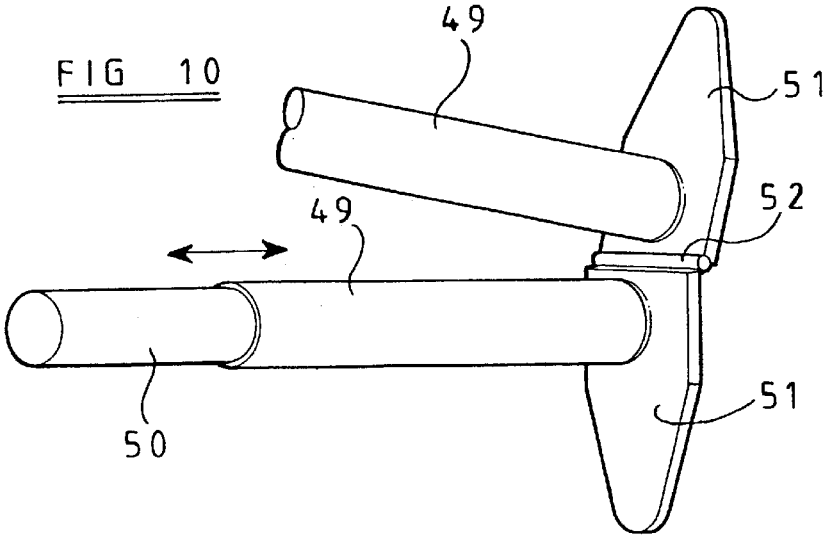

FIGS. 5 and 6 are diagrammatic perspective views showing in greater detail alternative arrangements for adjustably mounting the clamping devices on the device, FIG. 7 is a diagrammatic section through part of a further form of device according to the invention, FIG. 8 is a further modified version of the arrangement shown in FIG. 3, FIG. 9 is an enlarged view of part of an alternative arrangement, and FIG. 10 is a diagrammatic perspective view of the arrangement shown in FIG. 9.

Figure 1:
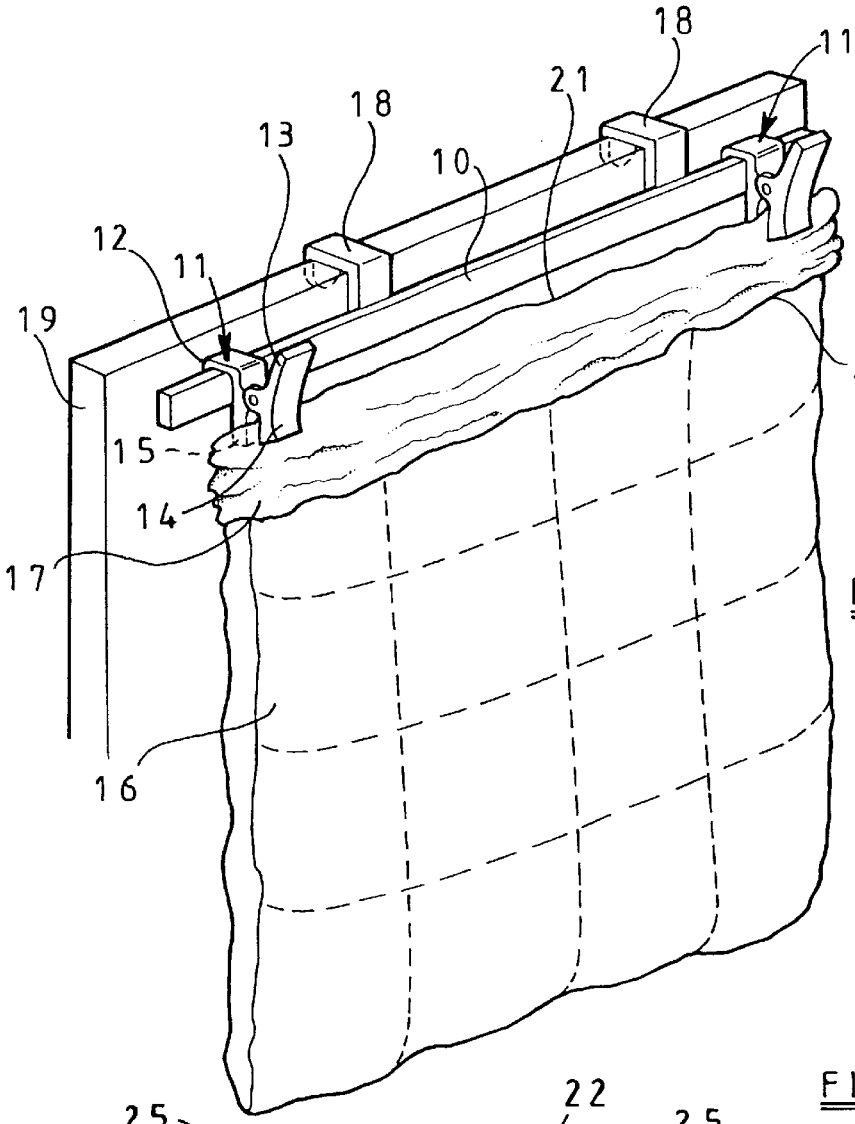
FIG. 1 is a diagrammatic perspective view of a simple form of device in accordance with the invention, in use.

FIG. 1 shows a simple form of device according to the invention to illustrate the principle of operation.

The device comprises a carrier 10 in the form of a simple one piece bar of wood, metal or other suitable material on which are mounted two spring clamping devices 11. Each spring clamping device comprises a part 12 which is adjustably slidable longitudinally of the carrier bar 10 and has pivotally mounted on it a lever element 13. A spring (not shown) urges a lower part 14 of the lever element 13 towards a downward extension 15 on the slidable part 12 so that the upper end of a duvet 16 and duvet cover 17 may be clamped tightly between the parts 14 and 15 as shown.

Two hooks 18 extend upwardly and rearwardly from the carrier bar 10 and are so shaped and dimensioned that they may hooked over the top edge of an open door 19 to support the device near the top of the door. (FIG. 1 is not to scale.)

In use, the device is hooked on to the top of the door and the clamping devices 11 are located on the bar 10 at a distance apart which is slightly less than the width of the duvet 16. The duvet cover 17 is then ruched up as shown so that the open end 20 of the cover is brought close to the opposite closed end 21. The ruched up cover is fitted over one end of the duvet 16 so that the upper corners of the duvet fit into the comers of the closed end 21 of the cover. The upper end of the duvet is then fitted into the clamping devices 11, as shown in FIG. 1, the corners of the duvet being gripped through the corresponding comers of the cover 17. The clamping devices 11 are then preferably moved apart as far as possible to render the upper edge of the duvet and duvet cover taut. Finally, the lower edge 20 of the duvet cover 17 is pulled downwardly over the duvet 16 until the open edge of the cover clears the lower edge of the duvet and the cover can be buttoned or otherwise closed. The clamping devices 11 are then released so that the covered duvet can be placed on the bed without any further manipulation being required.

It will be appreciated that all the operations described can easily be carried out by one person, regardless of the size of the duvet and cover.

Figure 2:
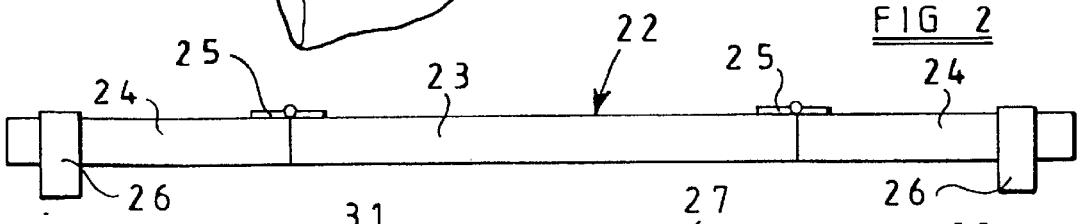
FIGS. 2–4 are diagrammatic elevations of modified versions of the device shown in FIG. 1.
Figure 4:
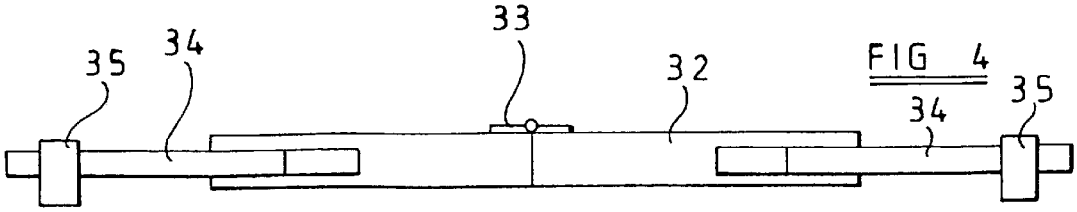

For clarity, FIG. 1 shows a carrier 10 in the form of a simple one-piece bar. However, to facilitate storage and transport it is desirable that the carrier should be collapsible from an extended condition to a smaller collapsed condition. FIGS. 2–4 show diagrammatically and by way of example typical arrangements whereby this may be achieved.

In the arrangement of FIG. 2 the carrier 22 comprises a central section 23 and two outer sections 24 connected together by hinges 25. The clamping devices 26 are slidably mounted on the outer sections 24 so that the distance between the clamping devices may be adjusted. The hinges 25 are located on the top side of the device so that their pivot axes extend transversely of the carrier 22. With such an arrangement, the weight of the duvet hanging on the clamping devices 26 tends to maintain the carrier in the extended position. It is possible to locate the hinges on the front, back or bottom side of the carrier, but in this case some form of retaining device is preferably provided to prevent the carrier 22 from collapsing and to retain it in the extended position shown in FIG. 2. For example, the hinges 25 may be of a type which snap to an overcentre position, or some form of manually operable hook or screw may be provided at each hinged joint to maintain the carrier in the extended condition. Three hinged sections are shown, by way of example, in FIG. 2, but it will be appreciated that the carrier may be divided into any other convenient number of hinged sections.

FIG. 3 shows an alternative arrangement where the carrier 27 comprises a central main part 28 along which are longitudinally slidable outer parts 29 on which the clamping devices 30 are mounted. The outer parts 29 may be slidable along slots 31 formed in the central part 28, the slots being T-shaped, dove tailed or otherwise undercut in cross-section to retain the parts 29 in the recesses. Alternatively, the recesses 31 may be cylindrical, the parts 29 being telescopically received within the cylindrical recesses. For example, the central part 28 of the carrier may be tubular.

FIG. 4 shows a combined arrangement where a central part 32 of the carrier is hinged, as indicated at 33, and has outer parts 34 slidably or telescopically engaging each outer end of the carrier.

In the arrangement of FIG. 2, the clamping devices 26 are slidably adjustable on the parts 24. In the arrangements of FIGS. 3 and 4, the clamping devices 34, 35 could also be slidably adjustable on the parts 29, 34 which carry them. However, since the parts 29, 34 which carry the clamping devices are themselves adjustable longitudinally, the clamping devices 30 and 35 could, in these cases, be fixedly connected to the parts 29, 34, longitudinal sliding movement of the parts 29, 34 then being used to adjust the distance between the clamping devices 30, 35.

It is desirable that the clamping devices should remain securely in their adjusted positions on the carrier as the duvet cover is pulled downwardly over the duvet, and that the clamping devices should not become displaced towards one another as a result of the downward pull. Where the slidable devices are solely frictionally restrained on the carrier it is desirable that the friction should be sufficient to prevent the devices from being displaced towards one another. For example, the arrangement of the clamping devices on the carrier may be such that they tend to dig into the surface of the carrier as a result of the downward pull.

Preferably, however, releasable detent means are provided so as positively to prevent the displacement of the clamping devices once they have been removed to the desired position. For example, in the simple arrangement shown in FIG. 1 the part 12 of each clamping device which slides on the carrier 10 may be provided with a releasable screw which, by means of a manipulating head, may be screwed through the part 12 into firm engagement with the carrier to lock the clamping device to the carrier.

Alternatively, the carrier bar 10 may be provided with holes within which a pin mounted on the clamping device may be engaged when the device is in the correct position. In another arrangement a spring latch device on the clamping device may be engageable with ridges or notches on the carrier bar 10, a manipulating member being provided to enable the latch to be disengaged from the notches when it is required to slide the clamping device along the bar.

FIGS. 5–7 show arrangements for retaining the clamps in the desired position in those cases where the clamps are mounted on members which are slidable with respect to the carrier.

In the arrangement shown in FIG. 5 the carrier 36 is in the form of a rectangular section tube within which is telescopically arranged a further tube or bar 37 of smaller cross section on which a clamping device (not shown) is fixedly mounted. In this case a screw 38 having an enlarged knurled head threadedly engages a wall of the carrier 36 so that it may be screwed into and out of engagement with holes 39 formed in the inner member 37. A plurality of such holes 39 are formed along the length of the inner member 37 and when the member has been withdrawn to the required extent to locate the clamping device in the desired position, the screw 38 is screwed into engagement with the nearest hole 39 to lock the member 37 to the carrier 36. Instead of the element 38 being a screw it could be a spring-loaded plunger which is engageable with the holes 39.

In such arrangements the clamping device can only be adjusted between discrete positions dictated by the spacing of the holes 39. In order to allow continuous adjustment, the holes 39 may be omitted, the member 37 then being locked to the carrier 36 by the frictional engagement of the end of the screw 38 bearing on the side surface of the member 37.

In the alternative arrangement shown in FIG. 6, the rectangular section carrier 40 is provided with a T-section slot 41 within the cross bar portion of which is slidable a member 42 on which the clamping device (not shown) is fixedly mounted. A large headed screw 43 engages within a threaded hole in the member 42 and, when the member 42 reaches the required position, the screw 43 may be tightened up so that the enlarged head of the screw bears against the side surface of the carrier 40, on each side of the slot 41, to prevent further longitudinal movement of the member 42. A stop 43 is provided in the slot 41 to limit the outward movement of the member 42.

In the further arrangements shown in FIG. 7 the member 44 on which the clamping device is mounted is slidable within a tubular carrier 45 and is formed along its length with notches 46 which are engageable by a spring-loaded pivoted latch 47 mounted on the carrier. As the member 44 is withdrawn to move the clamping devices apart, the latch 47 ratchets over the notches 46 and, when the clamping device is in the appropriate position, prevents movement of the member 44 in the opposite direction. Such movement can be achieved, when required, by pivoting the latch 47 to disengage it from the notches 46.

In the examples described above the clamping devices are in the form of spring-loaded lever arms where the pressure of the spring is relied upon to hold the devices closed with the duvet clamped between them. Such an arrangement is preferred for convenience, but other forms of clamping device are possible. For example, the clamping device may be in the form of two elements which are movable towards and away from one another by operation of the screw, somewhat in the fashion of a G-clamp. Such an arrangement may allow greater clamping pressure to be exerted on the duvet than is possible by a spring device, since a spring must not be so strong that the clamping device cannot readily be released by pressure on the lever part of the device.

Where the device according to the invention is used to cover a large duvet, the weight of the duvet and cover may make it difficult to pull the clamping devices apart sufficiently to render the top of the duvet taut. In any of the arrangements according to the invention, therefore, it may be desirable to provide one or more farther, intermediate clamping devices on the carrier so as to provide additional support to the top edge of the duvet. FIG. 8 shows diagrammatically such an arrangement, which is a modification of the device shown in FIG. 3.

In this case a third central clamping device 48 is mounted on the central part 28 of the carrier. The additional clamp 48 may normally be fixedly mounted on the carrier, but it could if desired be slidably adjustable along the main part 28. Two or more such intermediate clamps may be provided if required.

The intermediate clamping device 48 may be of any of the kinds referred to above and may, for example, be of similar construction to the outer clamps 30. However, FIGS. 9 and 10 show an arrangement where the intermediate clamp is of a different type.

Referring to FIGS. 9 and 10: the carrier comprises two tubular members 49 within which are telescopically slidable further members 50 on which the outer clamping devices are mounted, as in the arrangement of FIG. 3 and FIG. 8. In this case, however, the central clamping device is combined with the hinge connection between the two parts 49.

For this purpose, a clamp plate 51 is welded or brazed on to the end of each member 49, and the upper horizontal edges of the two plates are connected together by a horizontal hinge pin 52. This arrangement not only provides the required hinge connection between the members 49 but also provides a releasable central clamp on the device which may support the center region of the upper edge of the duvet which is stretched between the two outer clamps on the members 50.

In use, one end of the upper edge of the duvet is secured to one of the outer clamping devices (not shown) and a middle part of the duvet is placed across the face of the downwardly extending plate 51. The upper member 49 then rotated about the hinge pin 52 to bring it into line with the other member 49, as shown in FIG. 9, and as a result of this movement the other plate 51 swings down so as to clamp the central part of the duvet between the two plates 51. The other end of the top end of the duvet is then clamped to the other outer clamping device.

The clamp parts 51, which are pressed together by the weight of the duvet on the outer clamps, serve to support part of the weight of the duvet, at the center of its upper edge, and also relieves some of the downward and inward pull on the two outer clamping devices.

Although the use of supporting devices which can hook over a door are preferred, for convenience, other forms of support for the device are possible. For example, the supports on the carrier 10 may be designed to engage with hooks or a support bar mounted on a wall specifically for the purpose of supporting the device.

What is claimed is:

1. A device for use in fitting a duvet cover, to a duvet having a length and a width, the device comprising an elongate carrier having means for removably mounting the carrier on a support in a substantially horizontal position, and two releasable clamping devices mounted on the carrier in longitudinally spaced locations, at least one of the clamping devices being so mounted on the carrier that its position may be adjusted longitudinally thereof, whereby the distance between the clamping devices may be varied, the elongate carrier having a length sufficient to allow the clamping devices to be spaced apart from one another by a distance that is slightly less than the width of the duvet, the device further comprising one or more clamping devices mounted on the carrier and located between the first two clamping devices.

2. A device as claimed in claim 1, wherein both clamping devices are so mounted on the carrier that their positions may be independently adjusted longitudinally of the carrier.

3. A device as claimed in claim 1, wherein the further device or devices are fixedly mounted on the carrier.

4. A device as claimed in claim 1, wherein the carrier is in the form of an elongate bar.

5. A device as claimed in claim 1, wherein the carrier is collapsible to a reduced length.

6. A device as claimed in claim 5, wherein the carrier comprises two or more hinged sections.

7. A device as claimed in claim 6, wherein the sections are connected together by one or more hinges located at the top of the carrier for pivoting about horizontal axes transverse to the length of the carrier, whereby in use the sections tend to be held in an extended condition by the weight of the duvet suspended from the clamping devices.

8. A device as claimed in claim 5, wherein the carrier comprises two or more sections which are relatively slidable longitudinally between an extended condition and a collapsed condition.

9. A device as claimed in claim 8, wherein the relative slidable sections are telescopically arranged, one being slidable within another.

10. A device as claimed in claim 1, wherein the or each moveable clamping device is mounted directly upon the carrier.

11. A device as claimed in claim 1, wherein each clamping device comprises two relatively moveable parts which are urged towards one another by spring means.

12. A device as claimed in claim 11, wherein one of the parts of the clamping device is mounted upon the carrier.

13. A device as claim 1, wherein the means for mounting the carrier on a support comprises a hook device.

14. A device for use in fitting a duvet cover, comprising an elongate carrier having means for removably mounting the carrier on a support in a substantially horizontal position, and two releasable clamping devices mounted on the carrier in longitudinally spaced locations, at least one of the clamping devices being so mounted on the carrier that its position may be adjusted longitudinally thereof, whereby the distance between the clamping devices may be varied, the elongate carrier including two sections connected to one another by a hinge, each section of the carrier carrying a clamp plate, the clamp plates abutting one another when the sections lie coaxially with one another to form a further clamping device.

15. A method of fitting a duvet cover to a duvet having first and second corners comprising:

(a) taking a device comprising an elongate carrier having means for removably mounting the carrier on a support in a substantially horizontal position, and two releasable clamping devices mounted on the carrier in longitudinally spaced locations, at least one of the clamping devices being so mounted on the carrier that its position may be adjusted longitudinally thereof, whereby the distance between the clamping devices may be varied;

(b) suspending the device from the support;

(c) locating the first and second corners of the duvet adjacent the corresponding corners of the duvet cover;

(d) securing the first and second corners to respective ones of the clamping devices; and (e) pulling the duvet cover fully over the duvet.

* * * * *